US005845404A

United States Patent [19]

Jeffcoat

[11] Patent Number: 5,845,404

[45] **Date of Patent: *Dec. 8, 1998**

[54] MULTIPURPOSE HAND TOOL

[76] Inventor: Norman C. Jeffcoat, 35 Confederate Rd., Modoc, S.C. 29838

[ * ] Notice: The term of this patent shall not extend beyond the expiration date of Pat. No. 5,581,895.

[21] Appl. No.: 762,341

[22] Filed: Dec. 9, 1996

Related U.S. Application Data

[63] Continuation-in-part of Ser. No. 551,758, Nov. 7, 1995, Pat. No. 5,581,895.

[51] Int. Cl.[6] ..... B25F 1/02; B26B 1/00

[52] U.S. Cl. ..... 30/125; 30/294; 30/340

[58] Field of Search ..... 30/294, 125, 156, 30/278, 280, 309, 314, 317, 320, 321, 340, 342, 344, 298.4

[56] References Cited

U.S. PATENT DOCUMENTS

| | | | |
|---|---|---|---|
| 221,991 | 11/1879 | Adams | 30/125 |
| 230,393 | 7/1880 | Barker et al. | 30/340 |
| 250,526 | 12/1881 | Hardy | 30/122 |
| 273,621 | 3/1883 | Small | 30/125 |
| 319,294 | 6/1885 | Millspaugh | 30/305 |
| 420,090 | 1/1890 | Oakley | 30/122 |
| 870,678 | 11/1907 | Henson | 30/314 |
| 1,387,246 | 8/1921 | Earle | 30/340 |
| 1,546,975 | 7/1925 | Feller | 30/286 |
| 2,045,192 | 6/1936 | Kuhar | 30/298.4 |
| 2,283,017 | 5/1942 | Scott | 30/294 |
| 2,350,494 | 6/1944 | Champlin et al. | 30/340 |
| 2,980,996 | 4/1961 | Beran | 30/125 |
| 3,187,354 | 6/1965 | Frisbie | 30/294 |
| 3,241,236 | 3/1966 | Capps | 30/294 |
| 3,324,548 | 6/1967 | Mascia | 30/294 |
| 3,445,931 | 5/1969 | Knudson | 30/294 |
| 3,890,707 | 6/1975 | Cremonese | 30/340 |
| 4,062,117 | 12/1977 | Coleman | 30/317 |
| 4,198,751 | 4/1980 | Egbert | 30/286 |
| 4,442,570 | 4/1984 | Lynn | 30/314 |
| 4,817,221 | 4/1989 | Ryan | 30/298 |
| 5,033,987 | 7/1991 | Bloch | 30/314 |
| 5,113,587 | 5/1992 | Loomis | 30/340 |
| 5,127,162 | 7/1992 | Mansfield | 30/294 |
| 5,359,778 | 11/1994 | Seber et al. | 30/294 |
| 5,581,895 | 12/1996 | Jeffcoat | 30/294 |

*Primary Examiner*—Hwei-Siu Payer
*Attorney, Agent, or Firm*—Maria Reichmanis

[57] ABSTRACT

An ergonomically-designed, multipurpose tool including a handle, a blade with a shank and a tip, and a fastener for attaching the handle to the shank. The blade has a curved outer edge extending substantially from the shank to the tip, with, preferably, an integrally-formed gut hook positioned near the shank and opening toward the tip. A portion of the outer edge is sharpened to form a cutting edge. The fastener is user-operable for moving the blade from a first operating position where it opposes the handle to at least one next operating position, for example, extending forward of the handle for use as a hatchet. Regardless of the position of the blade, the user can control the length and direction of a cut by pivoting the wrist alone, the forearm at the elbow, the entire arm from the hand gripping the knife to the shoulder, by pushing or pulling the knife with the hand and forearm, or any combination thereof. Range of motion, dexterity and control of the cutting edge are thereby improved, with greater comfort than is possible with a conventional knife. The handle may include a compartment for storing one or more additional instruments for use therewith, such as a saw, a serrated blade, an ice pick, a fish hook, a knife blade, a file, a wrench, and a screw driver.

20 Claims, 9 Drawing Sheets

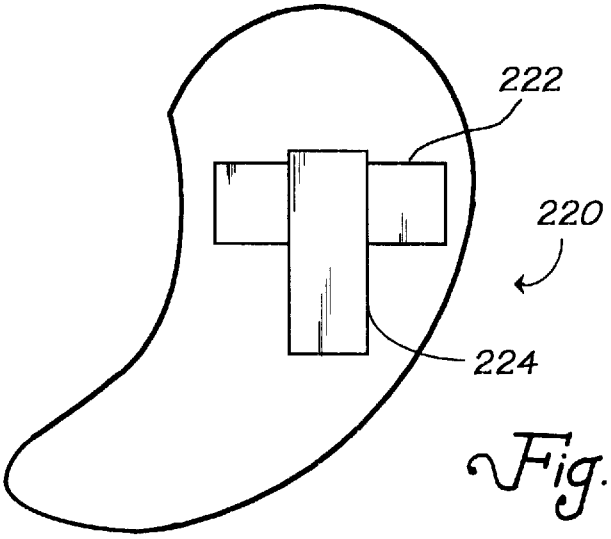
Fig. 18
Fig. 19A
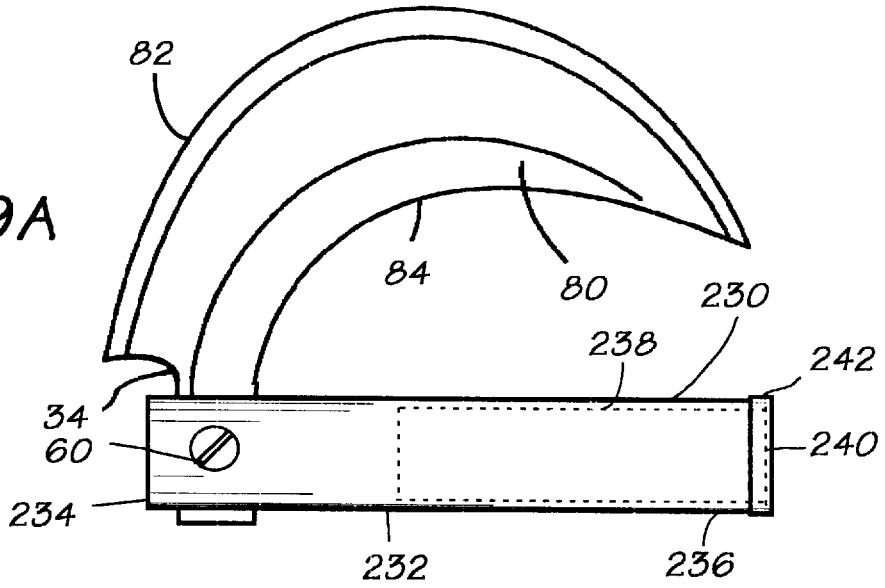
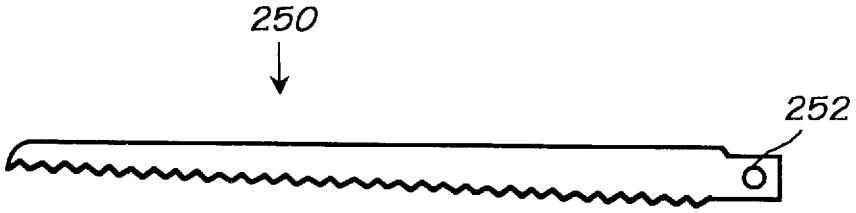
Fig. 19B

MULTIPURPOSE HAND TOOL

BACKGROUND OF THE INVENTION

1. Field of the Invention

This application is a continuation-in-part of application Ser. No. 08/551,758, filed Nov. 07, 1995, now U.S. Pat No. 5,581,895.

The present invention relates to hand tools. In particular, the present invention relates to an ergonomically-designed, multipurpose hand tool that includes a handle and a multi-position curved blade with a gut hook, and may include other attachments such as a screw driver, wrench, saw blade, and ice pick. The tool can be used for skinning and dressing game animals such as deer, and can readily be converted to other uses.

2. Discussion of Background

Man has been defined by Thomas Carlyle, Benjamin Franklin, and others as the tool-using and tool-making animal. An incredible variety of hand tools have been developed throughout the course of human history (as used herein, the term "tool" refers broadly to manually-operated devices that facilitate the performance of work, including but not limited to knives, saws, files, pliers, wrenches, screwdrivers, hand drills, hammers, hatchets, fish hooks, mallets, ice picks, and so forth).

Perhaps the single most useful hand tool for many outdoor activities is a knife. Knives are used by hunters for field-dressing game animals, by fishermen for cleaning their catch, and by backpackers, campers and others for a wide variety of outdoor tasks requiring cutting and slicing. Although an immense variety of knife designs are available, the overall design of hunting knives has changed very little over the centuries. To this day, most hunters use knives that are essentially indistinguishable from the Bowie knives and other designs used in the past.

Animals harvested in the field must be dressed quickly to retard spoilage and preserve the meat or fish for later consumption. As a general rule, the faster the meat cools from normal body temperature to typical refrigerator temperature, the slower the rate of spoilage and the more palatable the meat. Conversely, the slower the meat cools, the faster the progression of spoilage that adversely affects the quality of the meat. Therefore, fishermen routinely pack their catch on ice to retard spoilage. Hunters transport the carcasses of deer and other game animals to a butcher as soon as practicable, and frequently skin and gut the animals in the field (so-called "field dressing").

In the process of dressing a game animal, the hunter must skin, gut and quarter the animal using a variety of techniques including cutting, piercing, slicing, sawing and chopping. No matter what the species of animal, its hide must be removed by skinning before the meat can be butchered (skinning also helps speed up cooling by exposing the meat to the atmosphere). Gutting or eviscerating involves removing all the viscera from the abdomen and thorax of the animal. Ideally, the viscera are removed without puncturing the visceral linings, since puncturing releases the contents of the viscera into the abdominal cavity which quickly leads to contamination of the meat. Removing the viscera also prevents bacterial growth in the contents from spreading to the meat, and further helps cool the meat. The final operation is quartering, which involves severing the skeleton at various points to divide the carcass into smaller, more manageable sections. Quartering further speeds up cooling by exposing a greater surface area of meat to the atmosphere. Except for meat intended for cooking in camp, further butchering is usually deferred until after the meat is transported to a more convenient location (the hunter's home kitchen or a commercial butcher who is experienced in processing game).

Dressing game animals requires the mastery of a variety of cutting techniques and the use of cutting strokes of varying lengths, angles and directions. Cutting strokes may range from smooth, delicate strokes used for gutting and skinning, to more forceful strokes used for quartering and butchering.

Many hunters use conventional straight-bladed knives for at least part of the dressing process. However, these knives are not configured for the types of cuts required, and require great skill on the part of the hunter to effectively dress an animal. Even the most skilled hunters frequently find it difficult to dress game expeditiously without damaging or spoiling the meat. Furthermore, conventional knives—even hunter's knives and sportsmen's knives—have relatively long, thin blades which cannot easily cut through the bones and sinews of large game animals. Also, it is difficult to cut through the hide of an animal with a straight-bladed knife without puncturing the viscera, which quickly renders the meat unpalatable. Skinning with such knives is very slow and tedious, since great care must be taken not to damage the meat while making the necessary long cuts in the hide.

More recently, knife designs adapted from the Alaskan "ulu" have become available. These types of knife include a "gut hook" or "skinning gut hook," a backwardly facing, sharpened slot on the back side of the knife blade. To cut through the animal's hide, the hunter first pierces the hide with the tip of the knife. Then, he inserts the hook through the layer to be cut and draws it towards his body so that the hide or meat is cut by the sharpened inner edges of the slot. This type of knife is disclosed by Seber, et al. (U.S. Pat. No. 5,359,778).

Other knives with gut hooks include a "T"-shaped handle having a curved blade (with an integrally-formed hook) extending from the leg of the "T" (Bloch, U.S. Pat. No. 5,033,987). When using the blade, the user grips the arms of the "T" with the leg between any two fingers. Frisbie (U.S. Pat. No. 3,187,354) shows a combination tool with a blade that curves slightly at both ends, with a gut hook at one end and a handle that is approximately centered on the blade. Ryan's multipurpose survival tool (U.S. Pat. No. 4,817,221) includes a curved blade with sawteeth at one end. The blade has four finger openings so that it can be gripped and used for cutting; alternatively, the blade can be secured to a handle for use as a hatchet. Curved openings at each end of the blade are used for skinning animals or opening cans. In U.S. Pat. No. 3,445,931, Knudson describes a knife with a "C"-shaped dressing tool attachment extending back over the knife blade. Capps (U.S. Pat. No. 3,241,236) discloses a game knife with an elongated blade which is curved at one end. The curved portion has a sharp projection used for making a starting cut in the hide, and a blunt tip which pushes the animal's inner organs away when cutting through the hide. Feller (U.S. Pat. No. 1,546,975) shows a fish splitting knife with a curved tip, and a rounded bead at the tip to prevent damage to the roe. Egbert (U.S. Pat. No. 4,198,751) shows a skinning knife with a straight cutting edge and an integral hook. A ball mounted at the tip of the hook allows the user to slice through the skin of an animal without cutting the underlying flesh.

Hooks are found in other tools, including Mansfield (U.S. Pat. No. 5,127,162), a hand-held cutting tool with an "O"-shaped handle with a slot for inserting a straight-bladed knife, and a piercing blade approximately parallel to the bottom wall of the handle; Coleman, (U.S. Pat. No. 4,062,117), a rescue tool with a "U"-shaped handle and a small, straight-edged cutting blade extending from one side of the handle; Lynn (U.S. Pat. No. 4,442,570), a shrimp preparation tool having a cup positioned on the curved edge of the blade for catching the legs of the shrimp being peeled.

Many different types of handles are available to assist the user in performing various types of cutting strokes. Frisbie (U.S. Pat. No. 3,187,354) shows a knife handle with a hole. The user simply inserts a stick into the hole to convert the knife to a hatchet. Barker, et al. provide an attachable brace to convert a knife to a cheese-knife (U.S. Pat. No. 230,393). Loomis (U.S. Pat. No. 5,113,587) and Cremonese (U.S. Pat. No. 3,890,707) describe knives with handles that partially extend over approximately straight blades that extend forwards of the handles.

Multiposition handles are also known. These include Oakley (U.S. Pat. No. 420,090), a meat knife with a slightly curved blade and a collapsible, two-position handle. In the first position, the handle is directly over the blade for use as a chopping knife; in the second position, the handle is in the normal position for use as a butcher knife. Both Hardy's hoe (U.S. Pat. No. 250,526) and Millspaugh's knife (U.S. Pat. No. 319,294) have handles that can be rotated by 90° (Hardy, in a plane perpendicular to the plane of the hoe; Millspaugh, in the plane of the blade). Henson shows a pruning knife with a curved blade that can be fitted into the handle in six different positions (U.S. Pat. No. 870,678).

Most people who enjoy outdoor activities such as hunting, fishing, backpacking, etc. prefer to carry a few well-designed, versatile tools rather than a large assortment of specialty tools. However, versatility frequently comes at a price: compromises in the size, configuration and range of motion of a multipurpose tool may adversely impact its effectiveness for any particular task. Thus, a tool that can be used to perform many tasks may not perform any of these tasks well. Furthermore, presently-available tools with knife blade-gut hook combinations are not designed with a view to the biomechanics of the human hand and arm. Tools of this type typically provide a limited range of motion, require the application of an excessive amount of force for effective cutting, and, for many types of cuts, require the hunter to hold his hand at an angle which prevents the efficient application of force to the workpiece.

There is a need for an ergonomically-designed, multipurpose hand tool with a blade that can be used by hunters, sportsmen, and others to perform a variety of cutting operations (skinning, slicing, gutting, chopping, butchering, and so forth). Such a hand tool should be rugged and durable, simple and economical to manufacture, easy to use, and adaptable for a variety of uses without significant compromises in efficiency.

SUMMARY OF THE INVENTION

According to its major aspects and broadly stated, the present invention is a multipurpose knife/tool having a handle, a curved blade with a shank and a tip, and means for attaching the handle to the shank. The blade has an inner edge and a curved outer edge extending substantially from the shank to the tip, at least a portion of the outer edge being sharpened to form a cutting edge. A gut hook may be formed in the outer edge of the blade. Preferably, the attaching means is user-operable for moving the blade from a first selected position to another selected position with respect to the handle. In the first position, the handle is positioned over the blade so that the knife is configured for skinning, gutting, chopping, and so forth. In another position, the blade may extend forward of the handle for use as a hatchet or cleaver. The handle may include a compartment for storing one or more attachments (serrated blade, saw blade, scalpel blade, ice pick, file, fish hook, screwdriver, wrench, etc.). These attachments may also be fastened to the handle in a user-selected position.

The ergonomic configuration of the blade and the handle constitutes a major feature of the present invention. When the blade is in the first selected position, the handle is positioned approximately in the plane of the blade, spaced apart from and opposing the inner edge such that a chord drawn between the shank and the tip forms an acute angle with the longitudinal axis of the handle. In this position, the knife is balanced so that force exerted on the handle and directed towards the blade is distributed approximately uniformly along the entire length of the cutting edge.

Skinning cuts are made by grasping the handle and pivoting the wrist to rotate the knife in the plane of the blade, thereby producing long, controlled strokes. Slicing cuts through a layer of material are made with the handle approximately perpendicular to the material to be cut, so the gut hook can cut through one layer without penetrating underlying layers. Chopping cuts are made by pivoting the wrist to rock the knife about an axis transverse to the plane of the blade. The cutting edge of the knife has a center of curvature positioned near the user's wrist, thus, the wrist simply pivots with respect to the forearm while the hand and wrist remain in approximately straight-line alignment with the forearm. This type of motion is easy and comfortable for substantially all persons, including those whose wrists have a limited range of motion due to conditions such as arthritis, carpal tunnel syndrome and other repetitive stress injuries.

In use, the knife can cut effectively and safely through all cutting directions around an almost 270° arc. The user controls the length and direction of the cut by pivoting the wrist alone, the forearm at the elbow, the entire arm from the hand gripping the knife to the shoulder, or any combination thereof. This gives the user a greater range of motion—for performing a greater range of cutting strokes—than is possible with a conventional straight-bladed knife. Comfort and safety are also improved because the user is always in control of the position of the blade.

An important feature of the present invention is the blade. The blade is generally crescent-shaped, with a curved cutting edge that is preferably approximately circular or elliptical. In a preferred embodiment of the invention, the cutting edge has an approximately constant radius of curvature of about 2"–5" (about 5–13 cm).

A gut hook may be formed in the outer edge of the blade, preferably facing away from the shank (that is, opening towards the tip) so that the knife can be used for slicing through a layer of material simply by grasping the handle and holding it substantially perpendicular to the surface of the layer to be cut. The inner edge of the blade is shaped so that when the blade is in the first position, there is a sufficient opening between the inner edge and the handle to accommodate the user's hand, thereby allowing the user to comfortably and safely grasp the handle while using the knife. The optimum dimensions of the blade depend on its configuration, the dimensions of the handle, choice of materials, and other factors that will be evident to those skilled in the art. If desired, the blade may include features such as a rust-resistant coating, serrations for use in sawing, and throughholes to decrease its weight.

A feature of the present invention is the handle, which may be made of any suitable materials including but not limited to metal, bone, wood, plastic, composite materials, and ceramics. The handle is dimensioned in accordance with the size of the blade and the size of the average human hand, preferably approximately 4"–6" long (about 10–15 cm). If desired, the handle may incorporate a thumb rest, indentations for the fingers, a hole or other means for attaching a belt loop, and so forth.

Another feature of the present invention is the attaching means which secures the handle to the blade. The relative positions of the handle and the blade may be permanently fixed; however, a quick-release, user-operable fastener that allows the user to change the position of the blade from a first selected position to another selected position if preferred. Thus, the invention is a multipurpose tool system that can be quickly and easily converted to the various uses and needs of hunters and others. It can be used for a variety of operations that otherwise require a hunter to carry several different tools: skinning, gutting, chopping, hacking, sawing, etc.

Still another feature of the present invention is the handedness of the knife. Unlike many hand tools such as scissors, the knife is configured so that it is neither left-handed nor right-handed. The handle can be comfortably grasped by whichever hand the user prefers—left or right—for the task to be performed. Whether held in the left or the right hand, the blade is oriented correctly for use.

Other features and advantages of the present invention will be apparent to those skilled in the art from a careful reading of the Detailed Description of a Preferred Embodiment presented below and accompanied by the drawings.

BRIEF DESCRIPTION OF THE DRAWINGS

In the drawings,

FIG. 18 shows a sheath usable with the invention;

FIG. 19A shows a side view of a multipurpose knife tool according to a preferred embodiment of the present invention; and FIG. 19B is a side view of an instrument usable with the tool of FIG. 19A.

DETAILED DESCRIPTION OF A PREFERRED EMBODIMENT

Figure 1:
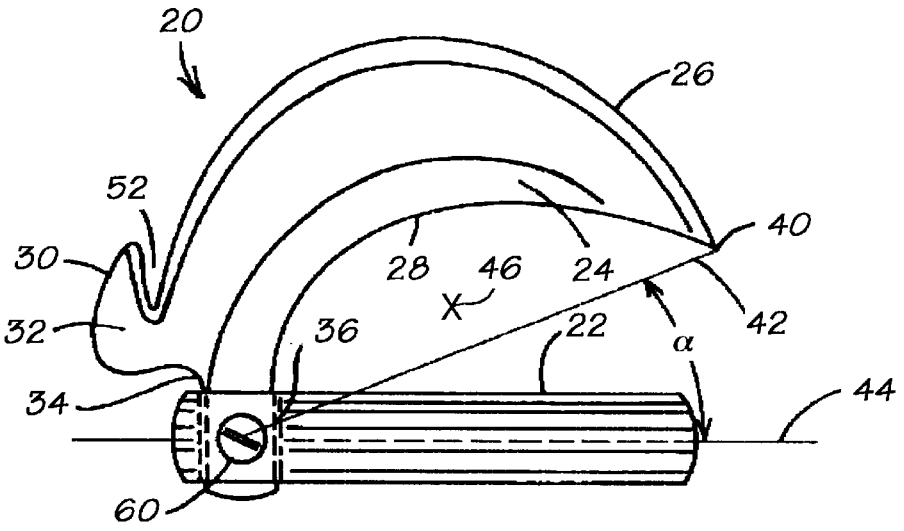
FIG. 1 is a side view of a knife in accordance with a preferred embodiment of the present invention, with the blade fixed in a first selected position.

In the following description, like reference numerals are intended to identify the same structural elements, portions or surfaces consistently throughout the several drawing figures, as such elements, portions or surfaces may be further described or explained by the entire written specification. As used in the following description, the terms "horizontal," "vertical," "left," "right," "up," "down," as well as adjectival and adverbial derivatives thereof, refer to the relative orientation of the illustrated structure as the particular drawing figure faces the reader. Similarly, the terms "inwardly" and "outwardly" refer to the orientation of a surface of revolution relative to its axis.

Referring now to FIG. 1, there is shown a multipurpose knife tool 20 in accordance with a preferred embodiment of the present invention. Knife 20 includes a handle 22, a curved blade 24, and may include other attachments to be described further below. Blade 24 has an outer edge 26, an inner edge 28, and, preferably, a gut hook 32 integrally formed with the blade. Gut hook 32 lies in the plane of blade 24, with a tip 30 that extends laterally outwards from outer edge 26 to define a tapered slot 52, substantially as shown in FIG. 1. Blade 24 has a shank 34 at one end thereof, inserted into a slot 36 in handle 22 and attached to the handle by a fastener 60. Edges 26, 28 of blade 24 meet at a tip 40.

Figure 13:
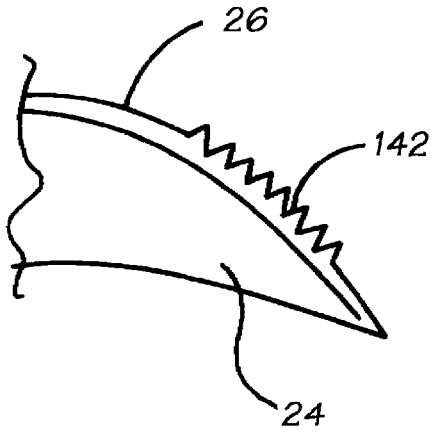
FIG. 13 shows a blade according to the invention, wherein a portion of the cutting edge is serrated.

A portion of outer edge 26 of blade 24 is sharpened to form a curved or arcuate cutting edge, another portion of outer edge 26 may be serrated for use in sawing (see FIG. 13). Inner edge 28 is preferably left unsharpened.

Figure 5A:
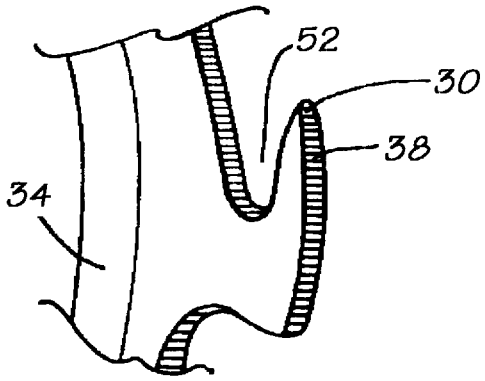
FIG. 5A is an enlarged, perspective view of a gut hook in accordance with the invention.

Tip 30 is approximately parallel to outer edge 26, oriented so that slot 52 opens toward tip 40 (i.e., facing away from shank 34). Gut hook 32 has a generally uniform outer surface 38 having approximately the same cross-section as the body of knife 20, tapered to form tip 30 (see FIG. 5A). Gut hook 32 is formed without sharp edges that could inadvertently tear the skin, meat, viscera, membranes or other tissues when knife 20 is used for slicing through a layer of material. By way of example, when knife 20 is used to slice through the hide of an animal, surface 38 glides over the underlying tissues, while tip 30 and edge 26 cooperate to guide the hide into slot 52 where it is cut by edge 26. As will be evident, knife 20 may be used in this manner for other slicing tasks, for example, cutting open cardboard boxes, slicing heavy-weight leather. etc.

Figure 5B:
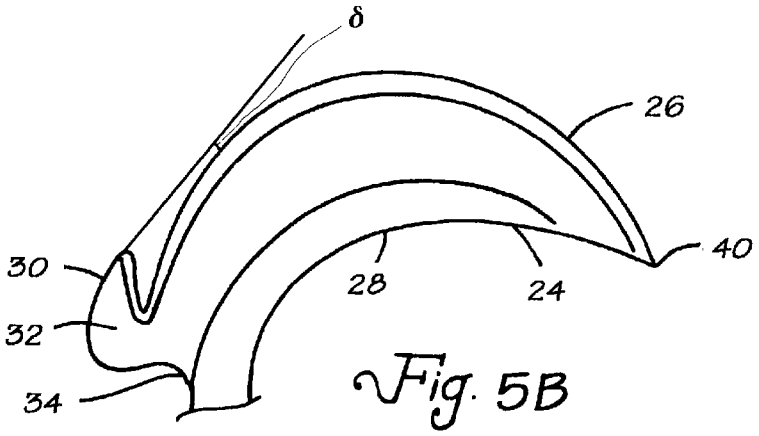
FIG. 5B illustrates the position of the gut hook of FIG. 5A in relation to the cutting edge.

To help ensure that cutting edge 26 does not cut into the underlying viscera when knife 20 is used for slicing through the hide, tip 30 preferably extends just past the outermost margin of cutting edge 26 by a distance δ (FIG. 5B). As will be evident, distance δ need be no greater than approximately 1/32"–1/8" (about 0.8–3.2 mm). However, other relative configurations of tip 30 and edge 26 may also be useful in the practice of the invention.

Figure 3:
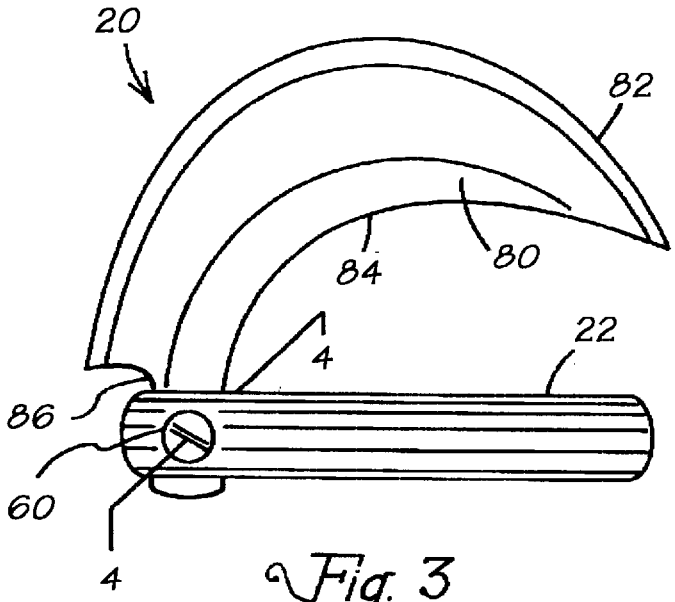
FIG. 3 is a side view of the knife of FIG. 1, with a blade in accordance with another preferred embodiment of the present invention.

If desired, knife 20 may have a blade 80 such as that shown in FIG. 3. Blade 80 has an outer edge 82, an inner edge 84, a shank 86, and, like blade 24, is attached to handle 22 by a fastener 60 of any suitable type.

Blades 24, 80 may be attached to handle 22 by any convenient type of fastener 60, including but not limited to screws, rivets, bolts, pins, quick-release fasteners, spring-loaded detents and the like. Fastener 60 is preferably of a type that allows the user to quickly and easily move blade 24 (or blade 80) from one operating position to another operating position, and secures the blade firmly in the selected position for use.

In a preferred embodiment of the present invention, blades 24, 80 have at least two operating positions with respect to handle 22. In a first position (FIG. 1), handle 22 lies in the plane defined by blade 24 (or blade 80), spaced apart from inner edge 28. In this position, a chord 42 drawn between shank 34 and tip 40 forms an acute angle α with a longitudinal axis 44 of handle 22. Preferably, angle α is no greater than approximately 45°. The first position is used for skinning, gutting, chopping, slicing and similar cutting operations.

Figure 2:
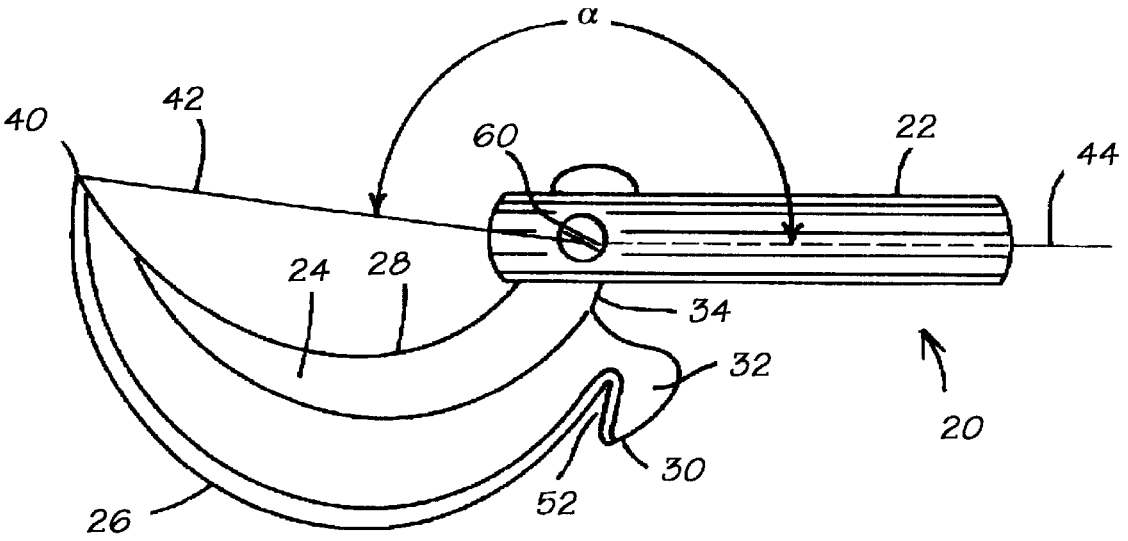
FIG. 2 is a side view of the knife of FIG. 1, with the blade fixed in second selected position, respectively.

In a second operating position, blade 24 extends forward of handle 22, so that chord 42 and axis 44 form an obtuse angle (FIG. 2). Here, angle α is between approximately 135° and 180°. When blade 24 is in the second position, knife 20 is configured for use as a hatchet.

Fastener 60 is preferably of a type that allows the user to quickly and easily move blade 24 from the first position to another position (including the second position shown in FIG. 2), and secures the blade firmly in the selected position for use. Blades 24, 80 may each have two fixed operating positions with respect to handle 22, approximately as shown in FIGS. 1 and 2. Thus, shank 34 of blade 24 (or shank 86 of blade 80) may be inserted into slot 36 and screwed or bolted into place in a first user-selected position (FIGS. 1, 3). In order to move blade 24 to a second user-selected position, the user need only remove fastener 60, remove blade 24, flip blade 24 to the second position and re-insert the blade into slot 36 (FIG. 2), and replace fastener 60. Alternatively, fastener 60 is a type of fastener that allows the individual user to select the most comfortable angle α for each type of cut. It will be evident that angle α can easily be adjusted to suit an individual user simply by adjusting the position of blade 24 with respect to handle 22.

Figure 4:
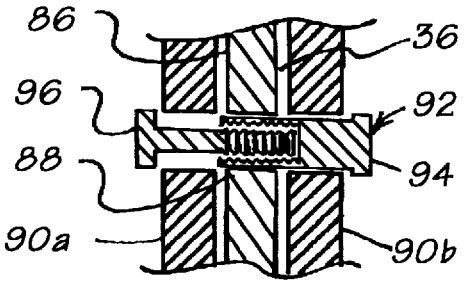
FIG. 4A is an enlarged, cross-sectional view of the knife of FIG. 3, taken along the line 4—4 of FIG. 3.
FIGS. 4B–4D are cross-sectional views of fasteners usable with the invention.
FIG. 4E is a plan view of the washer of FIG. 4D.

It will be evident that other types of fastener may be used with the invention, for example, the double screw type fastener shown in FIG. 4A. Handle 22 may terminate in spaced-apart walls 90*a*, 90*b*, forming above-described slot 36 for receiving shank 86 (or shank 34). A fastener 92 is inserted through a hole 88 in shank 86 to secure the shank to handle 22. Fastener 92 includes a first portion 94 having a threaded cavity at one end thereof, and a second portion 96 having a threaded end. Portion 96 screws into portion 94, generally as indicated in FIG. 4A, to secure shank 86 in place.

Figure 4B:
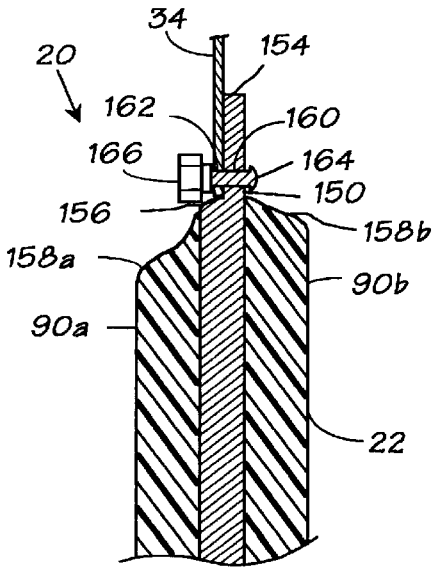
Figure 4C:
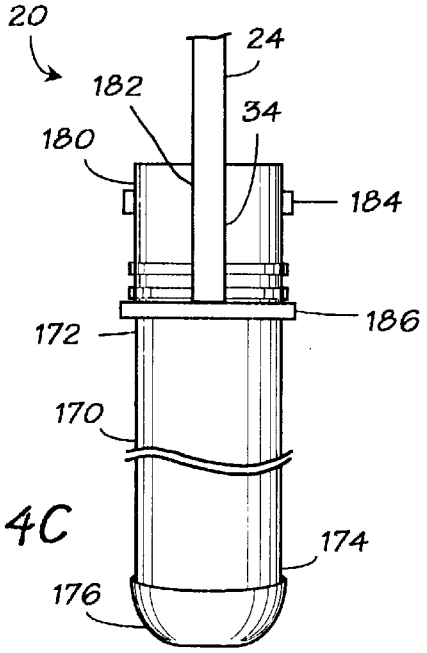
Figure 4D:
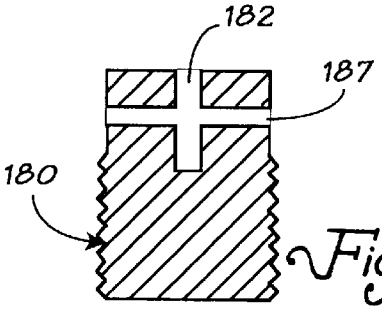

Additional fasteners are illustrated in FIGS. 4B–4D. A tang, which may extend the length of handle 22 or part thereof (FIG. 4B), is inserted between walls 90*a*, 90*b*. Tang 150 has a tip 154 and a shoulder 156, generally as shown. Walls 90*a*, 90*b* terminate in shoulders 158*a*, 158*b*, wherein shoulder 158*a* is lower than shoulder 158*b* in order to accommodate shank 34 of blade 24 (or blade 80). Tang 150 has a throughhole 160; shank 34 has a corresponding throughhole 162. When holes 160, 162 are aligned, a threaded nut or pin 164 and bolt 166 secure shank 34 in position.

Alternatively, a handle 170 has a first end 172 and a second end 174 (FIG. 4C). If desired, a weight 176 may be attached to second end 174. Weight 176 may be press-fitted into a suitably-dimensioned recess at end 174; alternatively, end 174 may be internally or externally threaded so that weight 176 may be screwed thereto. A threaded, bifurcated plug or split bolt 180 with a recess 182and a throughhole 187 (shown in cross-section in FIG. 4D) is screwed into a threaded recess at first end 172.

Figure 4E:
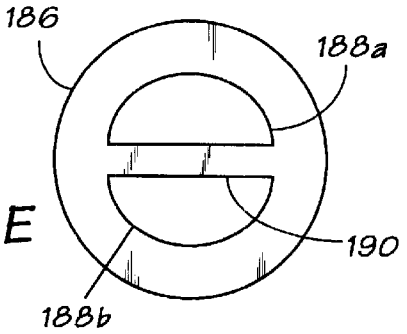

For blades (or other attachments) having a shank 34 that is significantly thinner than recess 182, shank 34 is inserted into the recess abutting a washer 186 (FIG. 4E). Washer 186 has two throughholes 188*a*, 188*b* dimensioned so that the washer can be placed over the ends of plug 180. Shank 34 abuts a bridge 190, and is secured in place with a fastener 184 (a roll pin, spring pin, expanding pin, clevis pin, detent pin, push-button quick release pin, or other suitable fastener). If desired, fastener 184 may have a ring (not shown) attached thereto for securing knife 20 to the user's belt. Attachments with shanks that are approximately the same thickness as recess 182 may be used without washer 186.

Figure 15A:
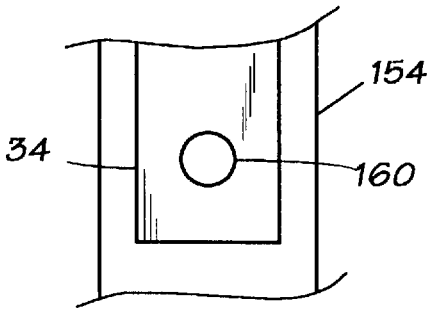
FIGS. 15A and 15B illustrate shanks in accordance with the invention.
Figure 15B:
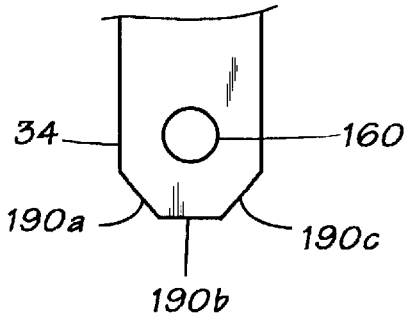

The above-described types of fastener can accommodate a plurality of operating positions for blades 24, 80. By way of example, a shank 34 may be positioned against end 154 of tang 150 with a throughole 160 as shown in FIG. 15A. If preferred, shank 34 may be rotated clockwise or counter-clockwise by 90° to provide the user with two additional operating positions. A shank 34 with three endfaces 190*a*, 190*b*, 190*c* (FIG. 15B) provides a total of five operating positions; additional endfaces 190, if present, provide additional operating positions.

Figure 14A:
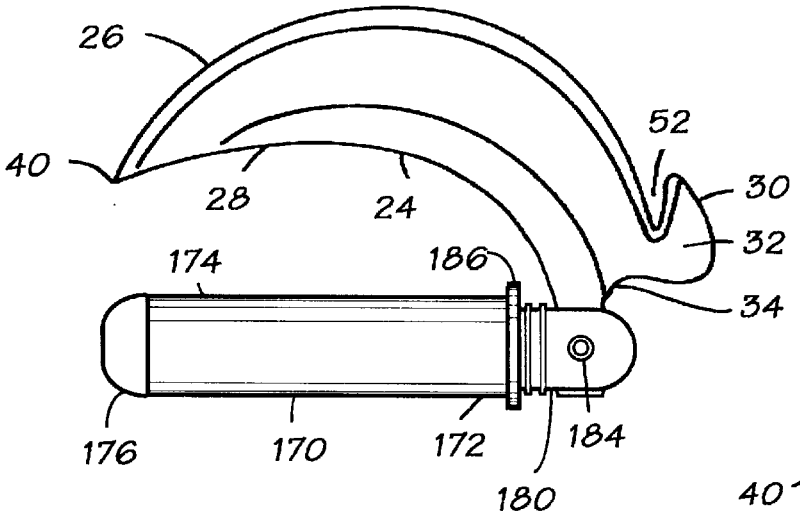
FIGS. 14A–C shows a knife in accordance with still another preferred embodiment of the present invention, wherein the blade is fixed in first, second, and third selected positions, respectively.
Figure 14B:
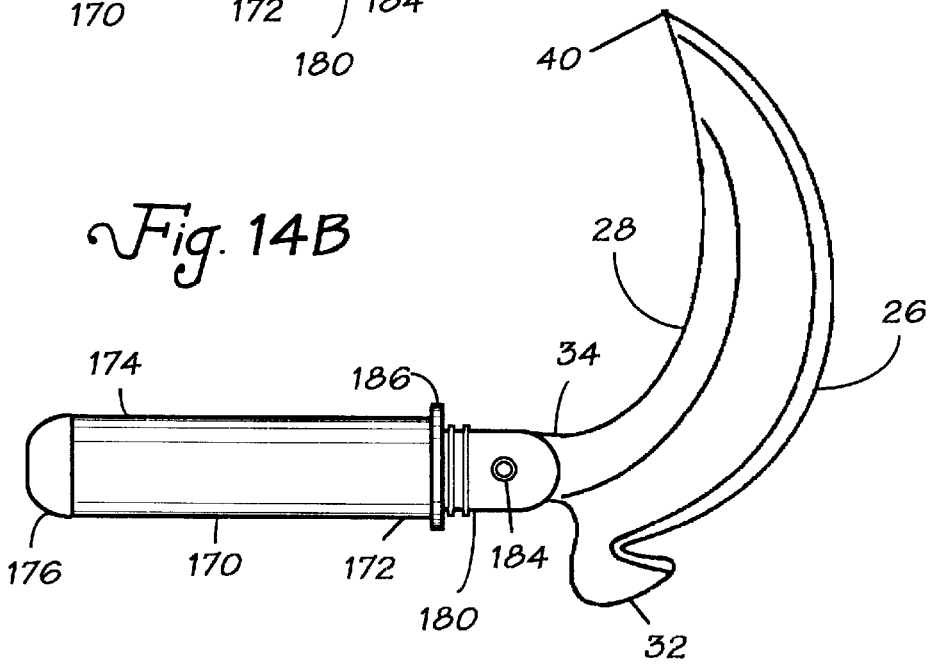
Figure 14C:
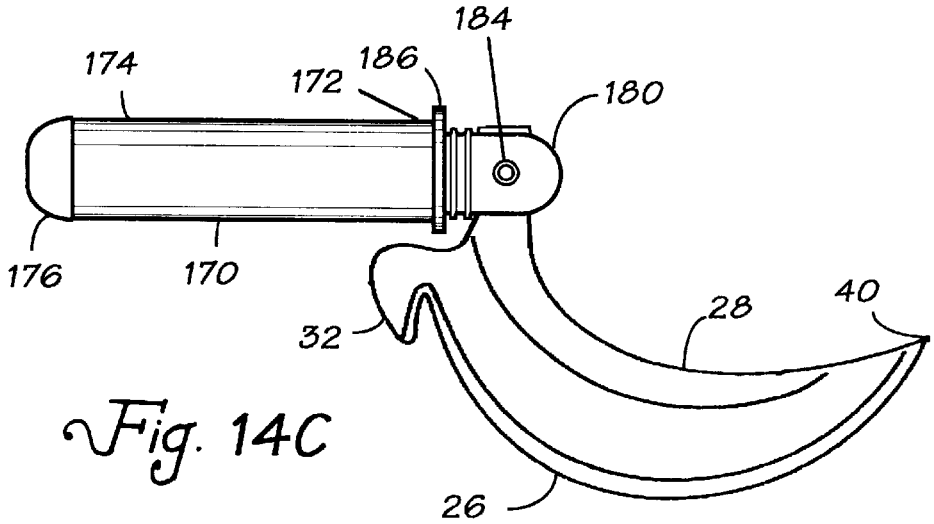

Similarly, plug 180 allows the user to select from at least three operating positions. In FIG. 14A, blade 24 is shown in a first position. In FIGS. 14B and 14D, blade 24 is in second and third operating positions, rotated by 90° and 180°, respectively, from the position of FIG. 14A. As will be evident, the position shown in FIG. 14A corresponds to the position illustrated in FIG. 1 where blade 24 is attached to handle 22; similarly, the position of FIG. 14C corresponds to the position shown in FIG. 2.

Figure 16:
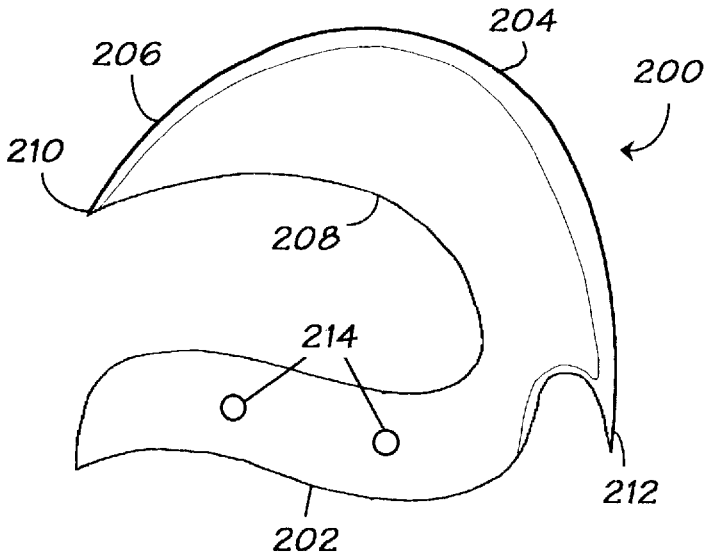
FIG. 16 shows a blade in accordance with another embodiment of the present invention.

Another blade according to the present invention is shown in FIG. 16. A fixed-position blade 200 has a tang 202 and an arcuate cutting portion 204, and is configured similarly to above-described blades 24, 80. Portion 204 has an outer, cutting edge 206, an inner edge 208 spaced apart from tang 202, a tip 210, and a prong 212. A handle of any desired type may be screwed or riveted to blade 200 via throughholes 214; alternatively, a suitable handle may be press-fitted or otherwise attached to the blade. If preferred, blade 200 may have a gut hook (similar to gut hook 32 of blade 24) instead of prong 212.

Knife 20 is compact and dimensioned to accommodate the user's hand. Thus, handle 22 (or handle 170) is approximately 4"–6" long (about 10–15 cm) and approximately ¾"–1½" in diameter (about 1.9–3.8 cm). The straight-line distance between shank 34 and tip 40 (represented by chord 42 in FIGS. 1 and 2) is approximately the same as the length of handle 22.

Outer edge 26 of blade 24 is curved (i.e., arcuate, crescent-shaped), preferably approximately partial-circular or partial-elliptical in shape, as are outer edges 82, 206 of blades 80, 200, respectively. However, other shapes may also be useful. For example, edge 26 may be a compound curve, a combination of curved and straight sections, or may define the major portion of a semicircle, with an approximately constant radius of curvature. Preferably, a sufficient portion of outer edge 26 is sharpened to provide a cutting edge approximately 6"–8" long (about 15–20 cm). Thus, outer edge 26 has a radius of curvature between approximately 2"–5" (about 5–13 cm), and a center of curvature 46 that lies within 1"–2" (about 2.5–5.0 cm) from axis 44 of handle 22 (FIG. 1). Inner edge 28 may also be curved, or otherwise shaped to accommodate the user's fingers. These dimensions were found to result in a knife 20 that is well-balanced, effective, and suitable for use by most adults. Furthermore, a knife having dimensions within these ranges is suitable for use on a wide range of game animals. Smaller knives may be useful for small animals, but are not practical for use on large animals such as deer or elk; larger knives may be operable, but quickly become awkward and unwieldy to use as the size of blade 24 increases. However, human hands vary in size, thus, the optimum dimensions of knife 20 for any particular user may lie outside the above-quoted ranges.

A blade according to the present invention is made of a hard, rugged and durable material, such as stainless steel, chromium steel, carbon steel, composite materials, ceramics, hard plastics, and like materials. Composite materials, ceramics, and hard plastics may be useful for skinning and gutting blades; metal blades, being heavier, may be preferred when knife 20 is to be used for chopping. By way of example, blades 24, 80, 200 may be machined of approximately ⅛"–¼" thick (about 0.32 –0.64 cm) types A2 or D2 tool steel, or type ATS-34 stainless steel. Other suitable techniques include stamping, laser-cutting, casting, high pressure water-cutting, and so forth. The blades may be finished by techniques such as air-hardening, bead-blasting, and the like, and may have a rust-resistant coating if desired. Rust-resistant coatings may be formed by any means known in the art, including nitride treatment, TEFLON-coating, and so forth.

Handles 22, 170 are approximately cylindrical and made of any suitable materials (metal, wood, plastic, horn, horn, composites such as graphite-impregnated plastic, etc.). The handles may be fabricated in one piece, or two or more sections that are fastened together. If desired, handles 22, 170 may be provided with thumb rest, indentations for the user's fingers, textured finishes, non-slip finishes, and so forth. Unlike many hand tools, handles 22, 170 (any blades 24, 80, 200) have no "handedness," that is, knife 20 can be used with equal comfort by left-handed and right-handed persons. In addition, the orientation of a fastener 60 may be reversed so that the user can comfortably operate the fastener with his dominant hand.

Figure 6:
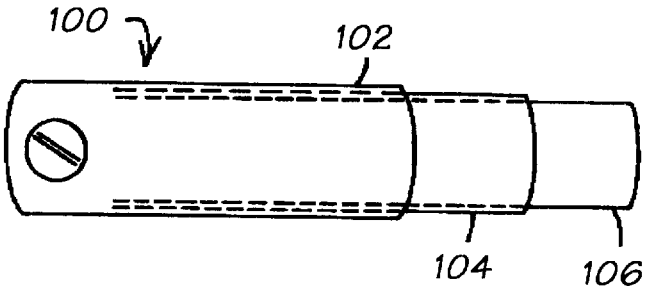
FIG. 6 is a schematic view of a telescoping handle usable with the invention.

To increase the user's range of motion, knife 20 may have an adjustable handle 100 having two or more telescoping sections such as 102, 104, 106 (indicated schematically in FIG. 6). When handle 100 is fully extended so that knife 20 is operable as a hatchet, blade 24 may be in either the first position (FIG. 1), the second position (FIG. 2), or whichever other selected position is more convenient for the user. Alternatively, handle 22 may be hollow so that the user can insert an extension into the handle.

Figure 7:
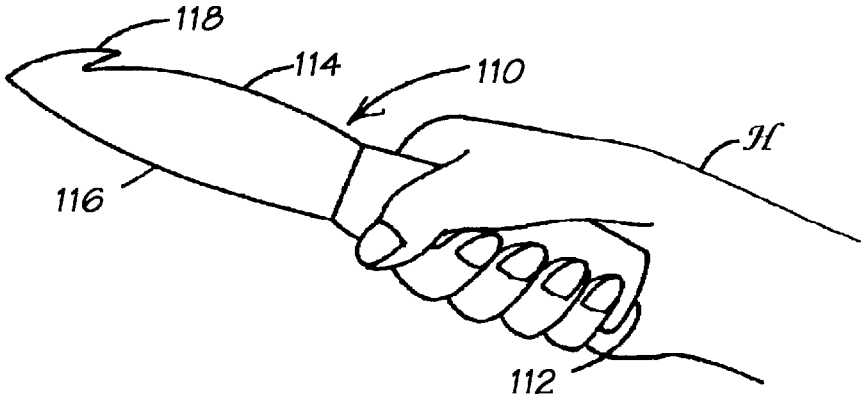
Fig. 7 Prior Art
FIG. 7 shows a user holding a prior art knife in a first position.

FIG. 7 shows a prior art knife 110 held in a first position, for example, preparatory to skinning (i.e, separating the hide from the underlying meat). Knife 110 has a handle 112, and an approximately coaxial blade 114 with a cutting edge 116 and a gut hook 118. When the user grips handle 112, blade 114 extends outward from the hand (indicated as H in FIG. 7). Thus, when knife 110 is positioned to make the types of cuts required for skinning, the user's wrist must be unnaturally cocked with respect to the forearm in order to apply cutting edge 116 to the carcass. The effective sweep of cutting edge 116 is limited by the available range of rotation of the wrist and forearm, which is limited because the wrist is cocked for most cutting operations. A cocked wrist limits the user's dexterity and ease of movement, since the muscles of the forearm are continuously extended and contracted to manipulate the knife and change cutting directions. The wrist and elbow are continually being rotated to uncomfortable positions, leading to strain and fatigue of the hand and forearm muscles. For persons with conditions such as arthritis, carpal tunnel syndrome and other repetitive stress injuries, and so forth, this type of motion may be difficult and even painful.

Figure 8A:
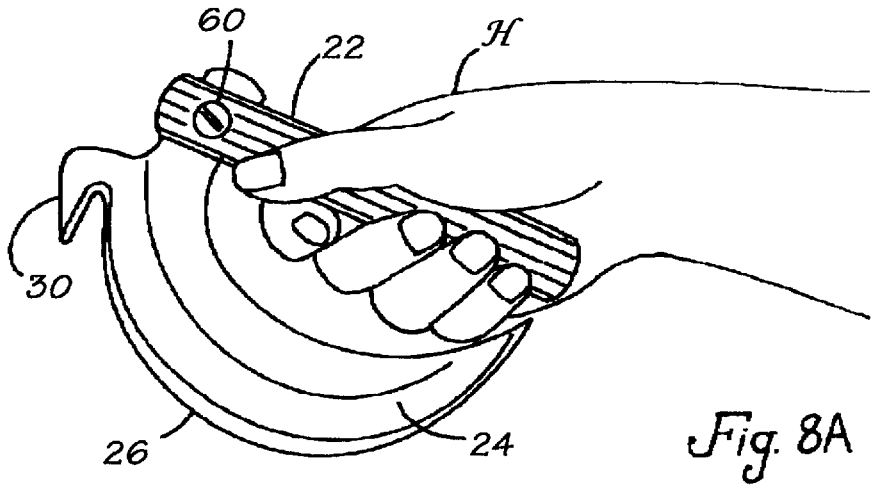
FIG. 8A shows a user holding the knife of FIG. 1 in a suitable position for skinning, with his wrist in a first position.
Figure 8B:
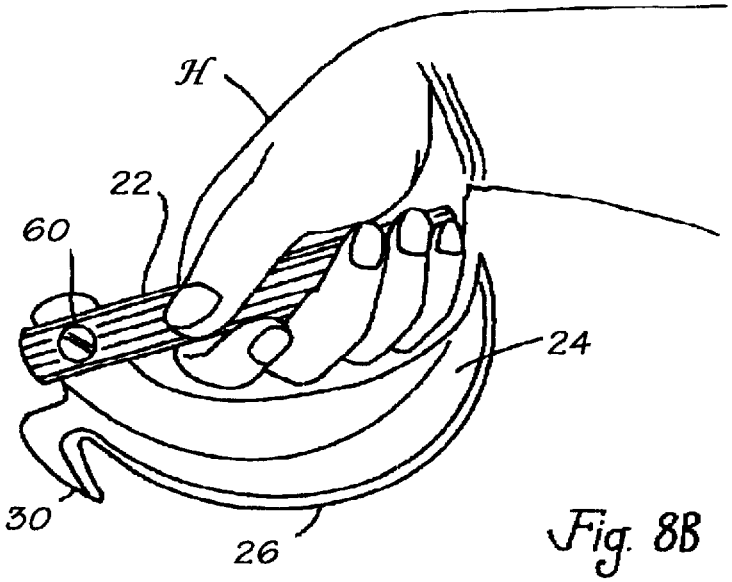
FIG. 8B shows the user of FIG. 8B after pivoting his wrist to a second position.
Figure 17:
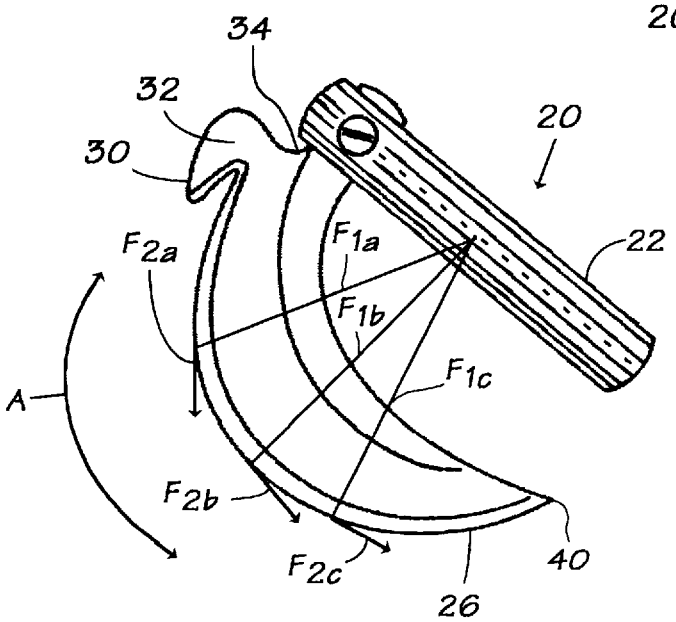
FIG. 17 illustrates the operation of the knife of FIG. 1.

In contrast, the user's hand H is aligned with the forearm when holding knife 20 for skinning and similar operations (FIG. 8A). The user simply pivots his or her wrist to make a cut that separates one layer of material (such as the hide of an animal) from the underlying tissues (FIG. 8B). As shown in FIG. 17, outer, cutting edge 26 of blade 24 is shaped so that a force $F_{1a}$ applied to handle 22 in a direction approximately perpendicular to the edge generates a cutting force $F_{2a}$ in a direction generally tangent to the edge. Similarly, a force $F_{1b}$ generates a cutting force $F_{2b}$, and a force $F_{1c}$, a cutting force $F_{2c}$. No matter what the direction of applied force $F_1$, cutting force $F_2$ remains approximately constant: that is, the user exerts an approximately uniform cutting force $F_2$ as he sweeps knife 20 through an arc A.

Essentially the entire length of outer edge 26 is available for cutting; in addition, the wrist is always approximately straight with respect to the forearm, so that the user's comfort and control are greatly improved. The user can change cutting directions by rotating the entire arm, rotating the forearm at the elbow, or simply by pivoting the wrist while maintaining the alignment of the wrist with the forearm. Because the wrist is straight, the forearm muscles remain relaxed. Thus, muscle strain and fatigue are minimized. This type of movement minimizes fatigue and discomfort, and therefore maximizes safety, for all users.

Figure 10:
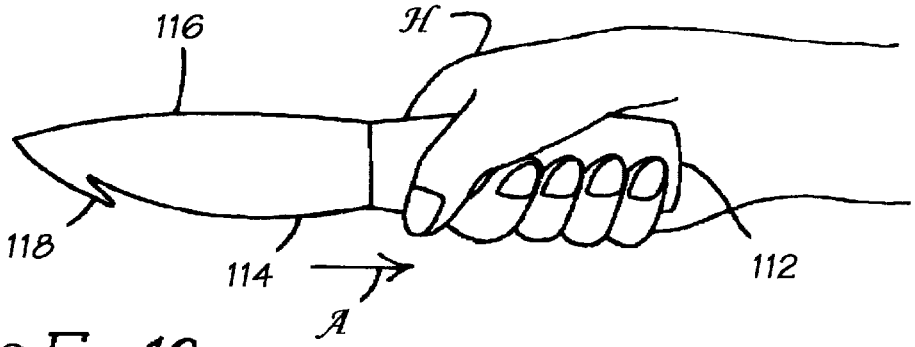
Fig. 10 Prior Art
FIG. 10 shows a user holding a prior art knife in a second position.
Figure 9:
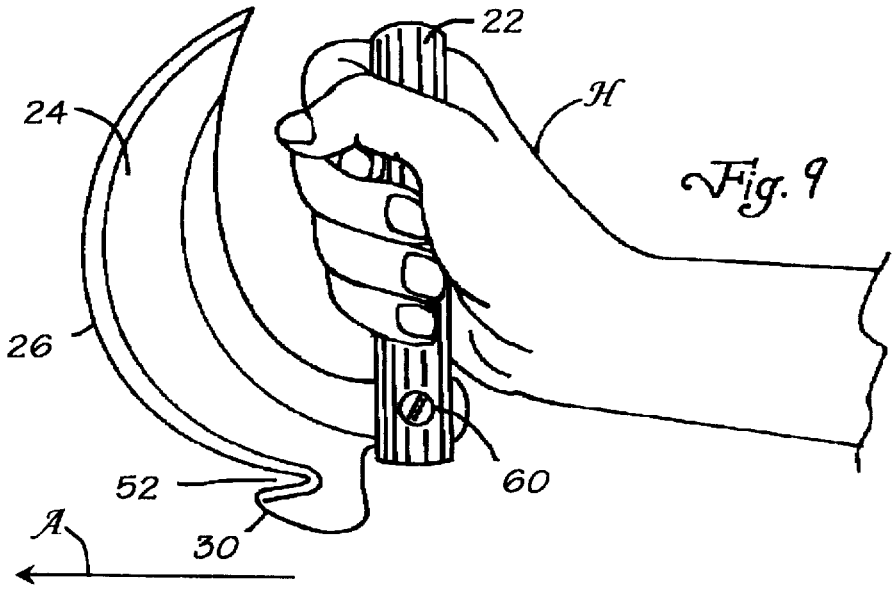
FIG. 9 shows a user holding the knife of FIG. 1 in a suitable position for slicing a layer of material.

FIGS. 9 and 10 show knives 20 and 110, respectively, held in suitable positions for slicing through a layer of material with a gut hook. In order to pierce and cut the animal's skin with gut hook 118, the user's wrist is generally cocked with respect to the forearm and blade 114 extends forward of handle 112 (FIG. 10). As gut hook 118 is drawn in the direction indicated by arrow A, the hook penetrates between the hide and the underlying meat, separating the hide from the meat and breaking the suction that would otherwise secure the hide to the meat. In order to keep gut hook 118 inserted in the proper position, the user's wrist must be held in an unnatural cocked position while the cut is made. For making cuts in the reverse direction to that shown in FIG. 10, the wrist is angled upwards and gut hook 118 is pulled upwards through the material being cut.

When using a knife 20 for this type of cut, the user grips handle 22 as shown in FIG. 9 and pierces the skin of the animal with tip 30. Tip 30 and the adjacent portion of edge 26 cooperate to guide the material into slot 52 as the user pushes knife 20 forwards in the direction of the cut (indicated by arrow A). The smooth, blunt surface of tip 30 does not damage the skin or underlying tissues while cutting edge 26 cuts through the skin. Force applied to handle 22 is transmitted directly to blade 24, maximizing the efficiency of the cutting stroke.

Figure 11:
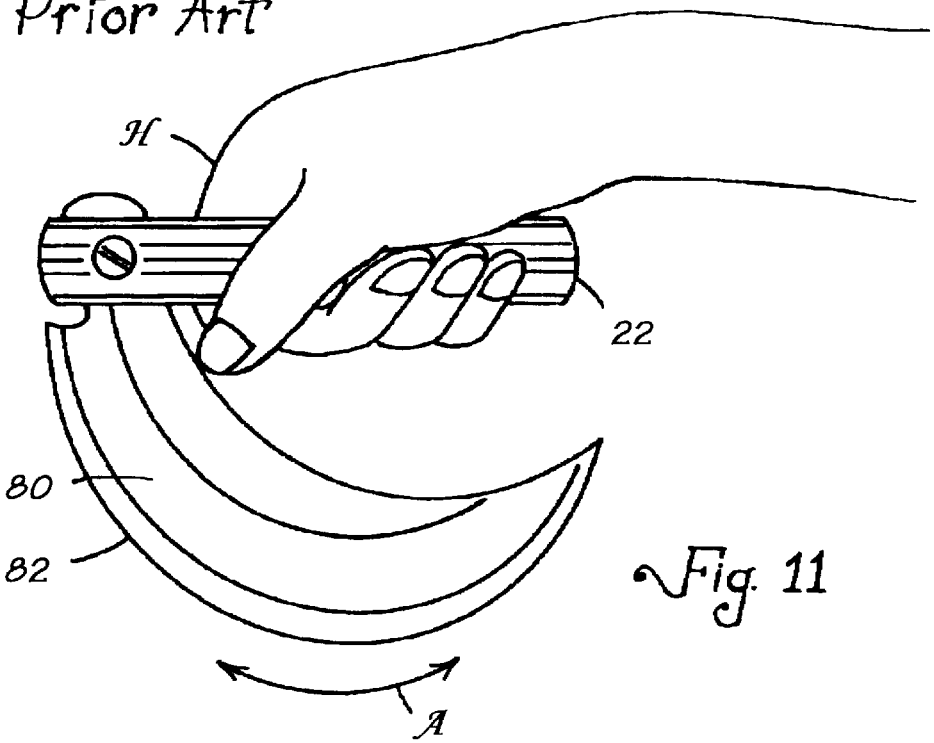
FIG. 11 shows a user holding the knife of FIG. 3 in a suitable position for chopping.

A knife according to the present invention may be used for chopping and slicing cuts (for example, chopping vegetables on a cutting board). For this type of cut, the user grips handle 22 and rocks blade 80 (or blade 24) back and forth as indicated by arrow A (FIG. 11).

Whether knife 20 is held in the user's right or left hand, and whatever the type of cut, the user's wrist is always in a natural, comfortable position with respect to the forearm. This results in a more stable and more powerful grip, and improves the user's ability to control the position of blade 24 while cutting. The long cutting edge of the blade also allows for fewer, smoother and more controlled cuts to accomplish the desired result. Safety is improved, because enhanced comfort and lessened fatigue reduce the chance of knife 20 slipping and injuring the user. Furthermore, because blade 24 (or blade 80) can easily be moved into a second position for use as a hatchet, the user has the advantage of having to carry only one tool into the field rather than two.

Figure 12:
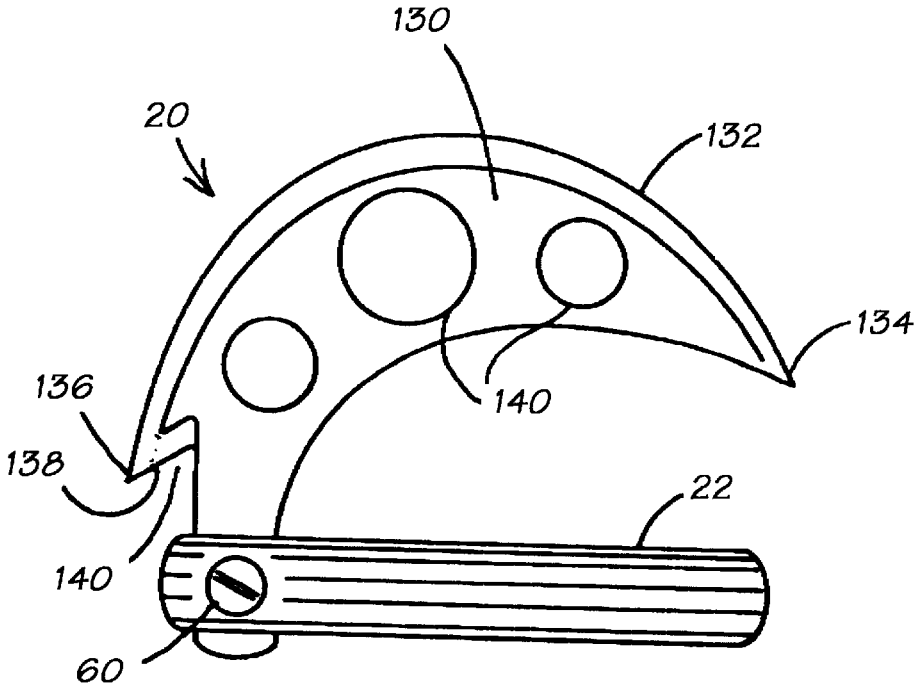
FIG. 12 is a side view of the knife of FIG. 1, showing a blade in accordance with another preferred embodiment of the present invention.

In accordance with the present invention, blades usable with knife 20 may include additional features such as throughholes, serrations, and so forth. By way of example, FIG. 12 illustrates a blade 130 having a cutting edge 132, a first tip 134 and a second tip 136. Tip 134 may have a sharpened edge 138 as shown, or be formed without sharp edges if preferred. Thus, tip 134 may be used as a gut hook, to make piercing cuts, etc. Tip 136 preferably lies in the plane of blade 130, defining a slot 140 substantially as shown in FIG. 12. Blade 130 is attached to handle 22 in the same manner as above-described blades 24, 80. A sheath (not shown) may be used to protect the blade when the knife is not in use The knife blade may have other features known in the art without departing from the spirit of the invention. In order to decrease the overall weight of blade 130 (or blades 24, 80), the blade may be provided with one or more througholes 140 (FIG. 12). Similarly, serrations may be formed in a portion of the cutting edge for use in sawing and like operations, for example, serrations 142 in cutting edge 26 (FIG. 13).

A knife according to the present invention may be provided with a sheath 220 to protect blade 24 (or blades 80, 200) when the knife is not in use (FIG. 18). Sheath 220 is shaped and dimensioned for holding a blade according to the invention, and includes at least one strap 222 with a loop 224 for attaching the sheath to the user's belt. Preferably, sheath 220 has two such straps 222, one on each side thereof Sheath 220, like knife 20 itself, has no "handedness": the sheath can be changed from "right-handed" to "left-handed" (or vice versa) simply by moving loop 224 from one of straps 222 to the other strap.

Referring now to FIG. 19A, there is shown a side view of still another embodiment of the present invention. A multipurpose knife tool 230 has a handle 232 with a first end 234 and a second end 236. First end 234 may have a slot 36 for receiving the shank of a blade; alternatively, first end 234 may be fitted with a plug 180 (FIG. 4C) or bifurcated shoulders 90*a*, 90*b* (FIG. 4B). Tool 230 is shown with a blade 80; however, it will be understood that blades 24, 200 may be used if preferred.

Handle 232 has a compartment 238 with an opening 240 at second end 236, closed by a plug or cap 242. Opening 240 may be threaded to accept a correspondingly threaded plug 242; alternatively, the plus may be press-fitted into opening 240.

Multipurpose tool 230 includes a set of a set of at least two instruments, wherein one instrument of the set is preferably a blade 24 (or a blade 80, 200). However, other blades or tools may be used. The other instrument(s) of the set may include a serrated blade 250 with a throughhole 252 at one end (FIG. 19B), an ice pick, a fish hook, a knife blade, a file, a wrench (Torx, Allen, crescent, etc.), and a screwdriver. Blade 250 (if present), as well as any other instruments of the set, may be attached to handle 232 in any selected position of a plurality of operating positions via a suitable fastener 60 (similarly to blades 24, 80, 200). Alternatively, the instruments may be attached to a suitable fitting or coupling on weight 176 or otherwise. Except for blades 24, 80, 200, all instruments of the set are dimensioned for storage in compartment 238 when not in use.

Multipurpose tool 230 provides the user with a versatile system for a variety of operations: cutting, skinning, slicing, etc. (with blades 24, 80, 200); sawing (with blade 250); and such other operations that may be performed with the instruments provided with the tool. As will now be evident, an individual user may readily customize tool 230 by selecting his or her choice of handle (handles 22, 170, 232, 100), with or without weight 176 and/or compartment 238; choice of blade (blades 24, 80, 200); choice of instruments in addition to the blade (with handle 232); and choice of fastener (fasteners 60, 92, etc.).

It will be apparent to those skilled in the art that many changes and substitutions can be made to the preferred embodiment herein described without departing from the spirit and scope of the present invention as defined by the appended claims.

What is claimed is:

1. A multipurpose tool, comprising:

a set of instruments, wherein one instrument of said set is a blade having a shank, a tip, a curved inner edge, and a curved outer edge extending substantially from said shank to said tip, at least a portion of said outer edge being sharpened to form a cutting edge;

a handle having a first end, a second end, and a compartment formed therein, said compartment having an opening at said second end, said compartment dimensioned for receiving at least one instrument of said set;

fastening means operable by a user to attach a selected instrument of said set to said first end of said handle; and means for closing said opening.

2. The multipurpose tool as recited in claim 1, wherein said fastening means further comprises means for attaching a selected instrument of said set to said handle in any one of at least two pre-selected operating positions.

3. The multipurpose tool as recited in claim 1, wherein said closing means is a plug, a threaded plug, or a cap.

4. The multipurpose tool as recited in claim 1, wherein said blade has a gut hook formed in said outer edge.

5. The multipurpose tool as recited in claim 1, wherein said set includes at least one instrument selected from the group consisting of a saw, a serrated blade, an ice pick, a fish hook, a knife blade, a file, a wrench, and a screw driver.

6. The multipurpose tool as recited in claim 1, wherein said outer edge has an approximately constant radius of curvature.

7. A knife, comprising:

a handle having a longitudinal axis, a first end and a second end; and a blade having a shank, a tip, an inner edge, and a curved outer edge extending substantially from said shank to said tip, at least a portion of said outer edge being sharpened to form a cutting edge; and means for attaching said handle to said shank of said blade so that said handle extends over said inner edge, said handle being spaced apart from said inner edge, said outer edge of said blade being having a center of curvature near said longitudinal axis so that, when said handle is grasped by a user, said center of curvature is near said user's wrist, whereby a force applied at a center of said handle directed towards said cutting edge generates an approximately uniform cutting force in a direction tangent to said cutting edge as said blade is swept through an arc.

8. The knife as recited in claim 7, wherein said outer edge has an approximately constant radius of curvature.

9. The knife as recited in claim 7, wherein said handle has a longitudinal axis, and wherein a chord between said shank and said tip forms an acute angle with said longitudinal axis.

10. The knife as recited in claim 7, further comprising a weight attached to said second end of said handle.

11. The knife as recited in claim 7, further comprising a gut hook formed in said outer edge near said shank, said gut hook opening in a direction away from said shank.

12. The knife as recited in claim 7, further comprising a prong formed in said outer edge near said shank.

13. A knife, comprising:

a handle having a first end and a second end;

a curved blade attached to said handle, said blade having a shank, a tip, an inner edge, and an outer edge extending substantially from said shank to said tip, a portion of said outer edge being sharpened to form a cutting edge, said blade having a plurality of operating positions including a first position wherein said handle extends approximately over said inner edge, said handle being spaced apart from said inner edge, and at least one next position; and user-operable means for attaching said blade to said handle in a selected position of said plurality of operating positions.

14. The knife as recited in claim 13, wherein said plurality of operating positions include a second position wherein said handle extends rearward of said blade.

15. The knife as recited in claim 13, wherein said outer edge has an approximately constant radius of curvature.

16. The knife as recited in claim 13, wherein said handle has a longitudinal axis, and wherein a chord connecting said shank and said tip forms an acute angle with said longitudinal axis when said blade is in said first position.

17. The knife as recited in claim 13, further comprising a gut hook formed in said outer edge near said shank, said gut hook opening in a direction away from said shank.

18. The knife as recited in claim 13, further comprising a prong formed in said outer edge near said shank.

19. The knife as recited in claim 13, further comprising a weight attached to said second end of said handle.

20. The knife as recited in claim 13, wherein said handle has a compartment formed therein, said compartment having an opening at said second end, and wherein said knife further comprises means for closing said opening.

* * * * *